United States Patent [19]

Hyman et al.

[11] Patent Number: 4,551,114

[45] Date of Patent: Nov. 5, 1985

[54] IMPACT-ACTIVATED TOY

[76] Inventors: Gregory E. Hyman, 12 Chester Pl., Bronxville, N.Y. 10708; Lawrence J. Greenberg, 43 Wilputte Pl., New Rochelle, N.Y. 10804

[21] Appl. No.: 463,844

[22] Filed: Feb. 4, 1983

[51] Int. Cl.[4] ..... A63H 5/00

[52] U.S. Cl. ..... 446/397; 446/227

[58] Field of Search ..... 46/232; 273/371, 376; 340/384 E, 384 R; 368/70; 446/297, 299, 302, 408, 397, 404, 227

[56] References Cited

U.S. PATENT DOCUMENTS

| | | | |
|---|---|---|---|
| Re. 24,722 | 10/1959 | Sterner et al. | 273/371 |
| 3,739,521 | 6/1973 | Fox | 446/302 |
| 3,798,833 | 3/1974 | Campbell | 46/232 |
| 4,033,108 | 7/1977 | Bennett et al. | 368/70 |
| 4,059,955 | 11/1977 | Prak | 368/70 |
| 4,209,174 | 6/1980 | Shiseki | 446/302 |
| 4,363,181 | 12/1982 | Hyman et al. | 46/232 |
| 4,373,918 | 2/1983 | Berman | 446/408 |
| 4,411,099 | 10/1983 | Cancel | 46/232 |

*Primary Examiner*—Robert A. Hafer
*Assistant Examiner*—Daniel Nolan
*Attorney, Agent, or Firm*—Henry Sternberg; Bert J. Lewen

[57] ABSTRACT

An impact-activated toy suitable for use in a child's crib which is capable of generating a series of melodies in response to successive impacts by a child spaced by more than, for example, ten minutes from the termination of the preceding melody. A momentary push-button switch for the mother's use is provided to cause the toy to generate a series of melodies in response to actuation by the mother when no melody is being generated or to stop the generation of any melody being generated at the time of the switch actuation.

5 Claims, 6 Drawing Figures

ROM VALUES:

| | | | | | | | | | | | | | | | |
|---|---|---|---|---|---|---|---|---|---|---|---|---|---|---|---|
| 000 | 00 | 33 | 65 | 0A | 7F | 70 | 7A | 0A | 33 | 3A | 2E | 70 | 33 | 11 | D2 | 0B |
| 010 | 4B | D5 | 33 | 01 | DA | 93 | 33 | 01 | DF | D5 | 2C | A2 | CC | 60 | 77 | 93 |
| 020 | 3D | 7E | 71 | 61 | 00 | 0B | 13 | EB | 8F | 60 | 6F | 2A | 61 | 06 | 39 | 8A |
| 030 | 13 | 60 | CA | 00 | 5E | BF | 1B | 8A | 39 | 00 | 5C | BF | 1D | 8A | 0E | 78 |
| 040 | 39 | 00 | 58 | BF | 3B | 8A | 1B | 05 | 4F | 33 | 01 | CD | F7 | AD | AD | 00 |
| 050 | B0 | 1C | 4F | 21 | DC | 0E | 22 | A7 | DF | 0B | 4D | E0 | 4F | AF | AF | A0 |
| 060 | A0 | 00 | 51 | B0 | 1C | 4F | 21 | C8 | 1B | 05 | 4F | A1 | CF | 0B | 4C | 3D |
| 070 | A2 | 61 | 00 | 0C | A7 | 60 | 20 | 93 | 33 | 01 | FC | F7 | 33 | 6D | FE | 4D |
| 080 | 80 | A2 | E0 | E2 | F4 | E9 | F9 | ED | FE | FF | 33 | 2E | 04 | 06 | 48 | 1D |
| 090 | 70 | 70 | 96 | 1D | 77 | 7E | 0D | 70 | 7D | 0D | 68 | A2 | 99 | 68 | A1 | 96 |
| 0A0 | 8E | 1D | 22 | 00 | 30 | AC | 04 | 00 | 30 | 8D | 44 | 49 | 44 | 44 | 44 | 8D |
| 0B0 | 0B | 01 | 52 | 50 | 33 | 3E | 3B | 05 | 51 | B8 | 3C | 05 | 44 | 51 | BC | 48 |
| 0C0 | E2 | DE | DD | D8 | D3 | CD | CB | C4 | BC | B8 | 03 | D0 | 11 | E5 | 60 | 25 |
| 0D0 | 11 | D9 | 0B | 11 | D7 | 47 | EB | 45 | E8 | 0B | 03 | DE | 46 | EB | 42 | E8 |
| 0E0 | 02 | 04 | 06 | 08 | 0C | 0B | 11 | EA | 60 | 6F | 45 | 32 | 39 | 05 | 3D | 30 |
| 0F0 | 44 | 06 | 3A | 05 | 03 | F9 | 56 | 44 | FC | 11 | FC | 52 | 3E | 30 | 44 | 06 |

| | | | | | | | | | | | | | | | | |
|---|---|---|---|---|---|---|---|---|---|---|---|---|---|---|---|---|
| 100 | 3E | 05 | 3D | BF | 60 | 2E | 00 | 04 | C6 | 33 | 11 | CE | 60 | 6F | 33 | 01 |
| 110 | D3 | 60 | 00 | 2A | 22 | 00 | 30 | 44 | 04 | D5 | 20 | C9 | 60 | 77 | 13 | 13 |
| 120 | 17 | 17 | 18 | 18 | 37 | 16 | 16 | 15 | 15 | 14 | 14 | 33 | AA | 17 | 17 | 16 |
| 130 | 16 | 15 | 15 | 34 | F9 | C9 | 80 | 27 | 08 | 17 | 16 | 15 | 16 | 37 | A8 | 14 |
| 140 | 15 | 36 | 15 | 16 | 37 | D2 | 34 | 37 | 15 | 43 | ED | 80 | 26 | 05 | 14 | 16 |
| 150 | 27 | 06 | 15 | 13 | 34 | 25 | 05 | 46 | F4 | 80 | 13 | 14 | 15 | 13 | DC | 15 |
| 160 | 16 | 37 | DD | 07 | 08 | 07 | 06 | 15 | 13 | DA | 13 | 10 | 33 | DD | EC | 80 |
| 170 | 25 | 04 | 13 | 14 | 15 | 15 | A9 | 35 | 14 | 14 | 34 | 15 | 17 | 37 | D2 | 15 |
| 180 | 15 | 14 | 14 | 15 | 14 | 43 | EA | 80 | 13 | 08 | 08 | 18 | 18 | 18 | 07 | 07 |
| 190 | 37 | 03 | 03 | 07 | 07 | 17 | 07 | 08 | 17 | 16 | 46 | ED | 80 | 13 | 13 | 16 |
| 1A0 | 26 | 07 | 18 | 16 | 26 | AA | 05 | 14 | 17 | 27 | 06 | 15 | 13 | 13 | CF | 06 |
| 1B0 | 17 | 17 | 13 | 13 | 46 | E8 | 80 | 00 | 23 | 03 | DE | 33 | 04 | 25 | 05 | DE |
| 1C0 | 35 | 37 | 27 | 08 | 27 | 05 | 23 | 04 | 25 | 05 | 24 | 04 | 43 | EA | 80 | 11 |
| 1D0 | 13 | 18 | 37 | 16 | 11 | 13 | 16 | 45 | 13 | 15 | 19 | 38 | A7 | 17 | 17 | 16 |
| 1E0 | 14 | 43 | CD | 16 | 17 | 14 | 15 | 46 | E7 | 80 | 07 | 08 | 07 | 06 | 05 | 03 |
| 1F0 | 13 | A9 | 04 | 05 | 04 | 03 | 02 | 00 | 10 | D1 | 05 | 11 | 12 | 43 | EC | 80 |

FIG. 5

IMPACT-ACTIVATED TOY

This invention relates to an impact-activated toy and, more particularly, to a toy suitable for use as a crib toy for a young child.

Sound-activated crib toys, for example, the sound-activated mobile described and claimed in our U.S. Pat. No. 4,207,696, which rotates in response to a child's crying, are known.

It is an object of the present invention to provide a new and improved impact-activated toy.

It is another object of the invention to provide a new and improved impact-activated crib toy for use by a young child.

It is another object of the invention to provide a new and improved impact-activated crib toy which has different modes of operation.

It is another object of the invention to provide a new and improved impact-activated toy which generates music.

In accordance with the invention, an impact-activated toy comprises a housing displaceable by an external impact thereon and an impact-responsive switch mounted in said housing. The toy also includes means responsive to actuation of the switch for generating sound appealing to a child in response to the momentary actuation of the switch caused by an impact on the housing.

For a better understanding of the present invention, together with other and further objects thereof, reference is made to the following description, taken in connection with the accompanying drawings, and its scope will be pointed out in the appended claims.

Referring now to the drawings.

Figure 1:
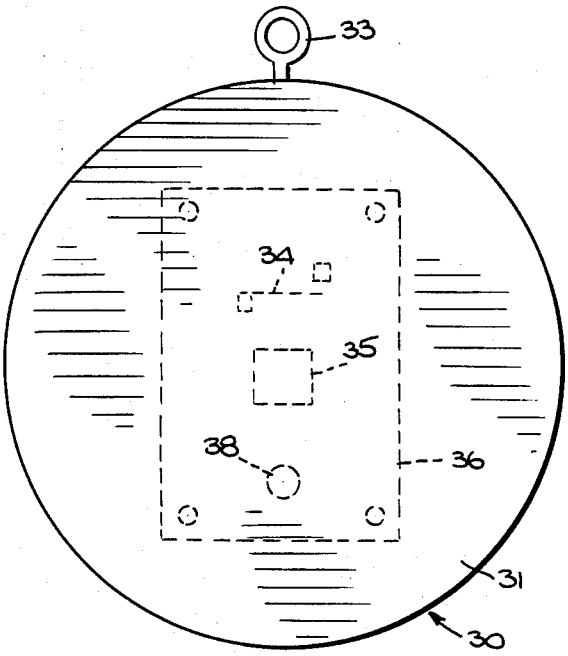
FIG. 1 is a plan view of an impact-activated toy constructed in accordance with the invention.
Figure 3A:
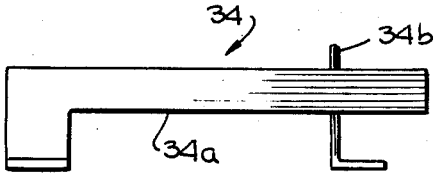
Figure 3B:
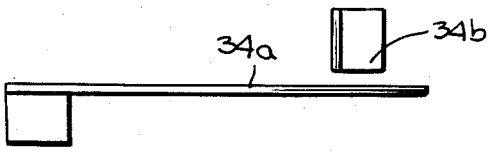
Figure 4:
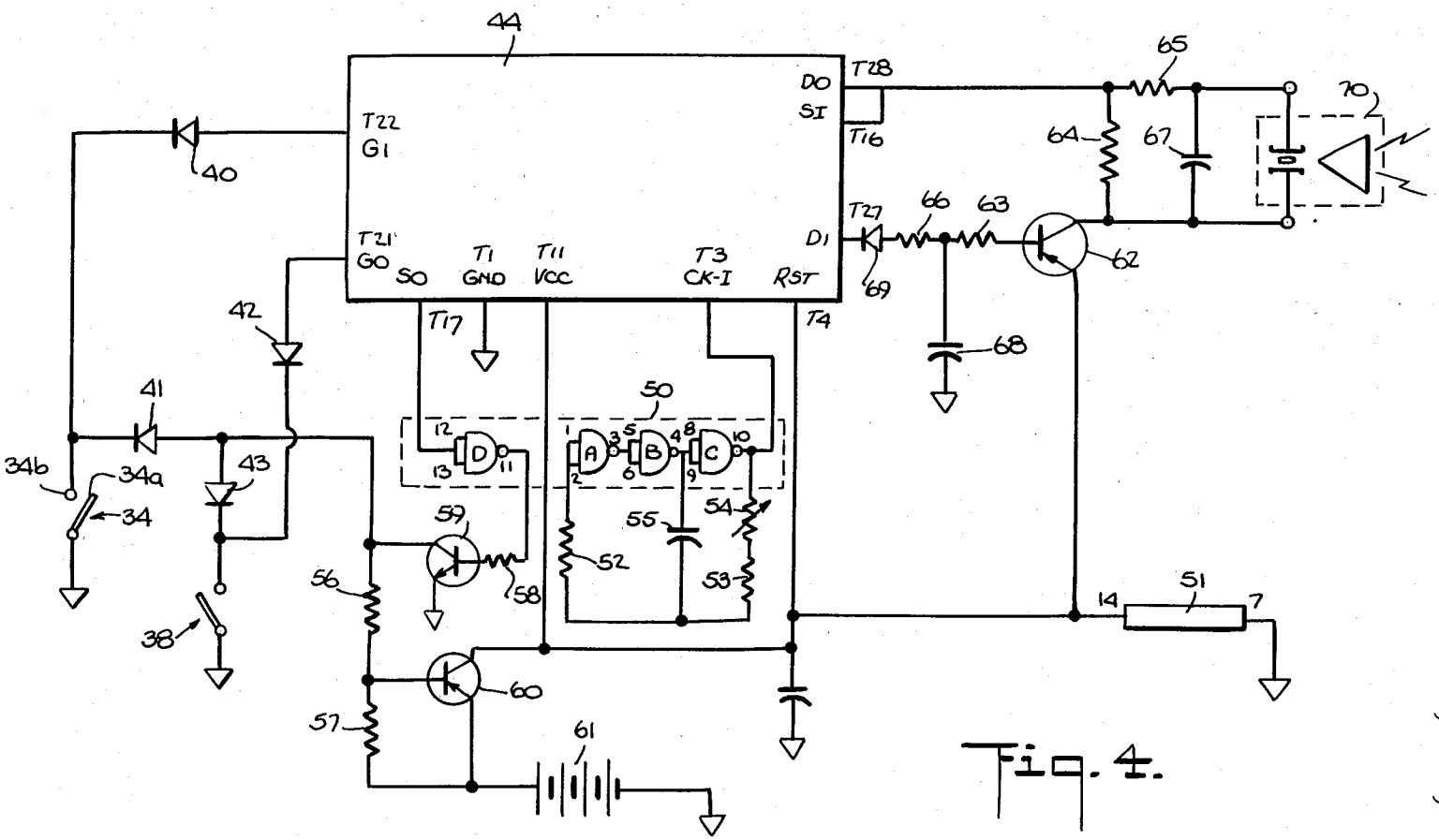

FIG. 3*a* is a side elevational view of a switch utilized in the FIG. 1 toy;

FIG. 3*b* is a plan view of the FIG. 3*a* switch;

FIG. 4 is an elevational schematic diagram of the toy; and

FIG. 5 is a respresentation of a program for the microprocessor represented in the FIG. 4 diagram.

Figure 2:
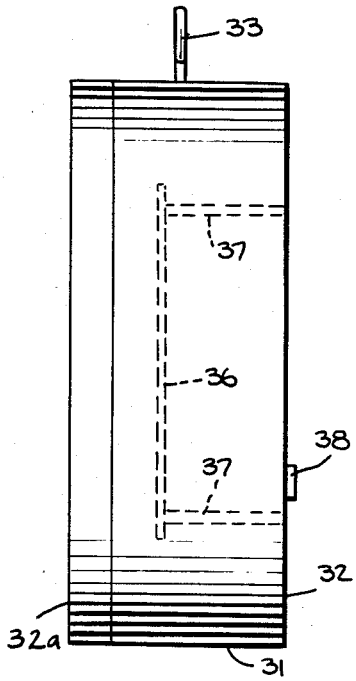
FIG. 2 is a side elevational view of the FIG. 1 toy.

Referring now more particularly to FIGS. 1 and 2 of the drawings, an impact-activated toy 30 constructed in accordance with the invention is there represented. The toy 30 includes, for example, a cylindrical housing 31 having separable portions 32, 32*a* of a suitable plastic material, which may be fastened together by any suitable means (not shown), for example, adhesive means. The housing 31 includes a suitable hangar 33 for hanging the housing from a rod (not shown) attached, for example, to a child's crib. The housing 31 is displaceable by an external impact thereon, for example, a push by a child.

The toy includes an impact-responsive switch 34 mounted in the housing. The toy also includes means 35 responsive to actuation of the switch 34 for generating sound appealing to a child in response to the momentary actuation of the switch caused by an impact on the housing. The switch 34 and the sound-generating means may, for example, be mounted on a suitable supporting board 36 attached inside the housing member 32 to suitable mounts 37, 37. The toy preferably also includes a momentary push button switch 38 for manually controlling the sound-generating means.

As represented in FIGS. 3*a* and 3*b*, the switch 34 preferably is an electromechanical switch comprising a thin, elongated arm 34*a* and a switch contact 34*b*. The members 34*a*, 34*b* may, for example, be made of brass having a thickness of 5 mils. The switch 34 is impact actuated, that is, the switch member 34*a* vibrates in response to an impact on the housing to make contact with the member 34*b*.

As will be explained more fully hereinafter, the sound-generating means 35 electronically generates music. The sound-generating means preferably generates a predetermined sequence of musical melodies in response to successive impacts of said housing spaced by less than a predetermined interval, for example, ten minutes, from the termination of a preceding melody. The sound-generating means preferably generates the same predetermined sequence of musical melodies i.e.—beginning with the first melody in such sequence—in response to successive impacts of said housing spaced by more than the aforesaid predetermined interval from the termination of a preceding melody. The sound-generating means generates a sequence of musical melodies in response to a first actuation of the manually actuated switch 38.

Referring now more particular to FIG. 4 of the drawings, there is represented an electrical schematic diagram of the toy. The switch 34 is represented as having a blade 34*a* movable to a contact 34*b* upon impact of the toy housing but normally in the open position. The switch 38 is also normally in the open position but may be closed manually as a momentary push-button switch. The circuit includes diodes 40, 41, 42, and 43 as components of the circuit for a microprocessor 44 which may, for example, be an integrated circuit COPS 444LR manufactured and sold by National Semiconductor Corp. and described in its July, 1981 bulletin. The microprocessor 44 includes a National Semiconductor EPROM (erasable programmable read only memory) that plugs directly into a socket of the microprocessor to form the COPS 444LR microprocessor. The EPROM portion of the microprocessor may, for example, be an MM2716 16,384-Bit UV Erasable PROM manufactured and sold by National Semiconductor Corp. and described in its 1980 "Memory" Databook. The EPROM portion of the microprocessor contains the program memory (software) that is represented in FIG. 5 showing the ROM (read only memory) codes that represent the program memory. The memory instructs the microprocessor as to the functions it should perform, for example, play music, and turn power on or off. The program is written into the read only memory of the microprocessor at the time of its manufacture. Such programs, which can be generated by those skilled in the art of microprocessor programming, are written in the so-called "machine language" of the particular microprocessor utilized. For the National Semiconductor microprocessor represented in FIG. 4, the sequence of numbers and letters set forth in FIG. 5 represents the correct machine language program to cause the microprocessor to perform the desired functions of the toy. It will be readily appreciated by those skilled in the electronic arts that the exact program to be utilized in the microprocessor of the toy of the present invention will depend upon the internal structure of the microprocessor itself and the choice of connections for the various electronic elements of the toy.

Such microprocessors include a plurality of exposed terminals which are sequentially numbered starting with the number 1 by the manufacturer. The connections of the various elements to these terminals are indicated by the numbering of the terminals in FIG. 4 in which the terminal numbers of the microprocessor 44 are preceded by the letter T and thus terminal T28 of FIG. 4 corresponds to terminal 28 of the microprocessor. The letters DO and the like correspond to letters also individually designating the terminals on the unit manufactured by National Semiconductor.

The toy also includes an integrated circuit 50 which is manufactured and sold by National Semiconductor as a CD4011M/CD4011C quadruple two-input NAND gate which contains four separate NAND gates and is described in National Semiconductor 1978 "CMOS" Databook. The NAND gates are labeled A,B,C,D and have terminal numbers 1 to 14 corresponding to the manufacturers terminal numbers on the physical unit. With terminals 1 and 2 connected as represented in FIG. 4, the gate A functions as an inverter. The remaining gates B, C and D are also connected to function as inverters. Gates A, B, C, resistors 52, 53 and variable resistor 54 and condenser 55 are coupled to form an oscillator operating at approximately 2.1 megahertz which provides the basic timing for the operation of the microprocessor 44. An oscillator or clock of this type is described in National Semiconductor Application Note AN-118, found in the 1978 "CMOS" Databook. Variable resistor 54 allows a small adjustment for precise setting of this frequency. Section D of integrated circuit 50, resistors 56, 57, 58, transistors 59, 60, and diodes 41 and 43 comprise the power turn-on-off circuitry. When either switch 34 or switch 38 is momentarily closed, transistor 60 will turn the integrated circuits 44 and 50 on, that is, supply power from batteries 61. The integrated circuit 44 will hold itself on through the same components until either the switch 38 is pushed again or the program memory of the integrated circuit 44 instructs it to turn itself off. A separately represented portion 51 of the integrated circuit 50 includes power supply terminals 14, 7 connected to the transistor 60 and ground, respectively, for supplying power to the integrated circuit 50.

With respect to the power turn-on, switches 34 and 38 are momentary switches that ground the cathodes of diodes 41 or 43 respectively. This ground is routed to resistor 56 and resistor 57 in order to turn on PNP transistor 60 which applies VCC (for example 6 volts DC) to terminal T11 of microprocessor 44. When microprocessor 44 senses VCC it immediately grounds its terminal T17 (SO) which is inverted to a logic high (for example, 6 volts DC) by section D of integrated circuit 50. Current from the section D of integrated circuit 50 turns NPN transistor 59 on through resistor 58 which holds transistor 60 on through resistors 56 and 57, thus latching power on to all components. Section D of integrated circuit 50 and transfer 59 are necessary in order to isolate VCC (6 volts DC) from integrated circuit 44 terminal T17 when power is turned off. This assures that there will be no current leakage path back to ground through the substrate of integrated circuit 44.

With respect to power turn-off, switch 38 also provides a momentary ground to terminal T21 of integrated circuit 44 through diode 42. The program stipulates that whenever music is playing, a momentary grounding of terminal T21 (GO) of integrated circuit 44 will instruct integrated circuit 44 to cause its terminal T17 (SO) to change from a logic low (ground) to a logic high (6 volts DC). This action releases the latched condition of transistor 60 and interrupts VCC (6 volts DC) to terminal T11 of integrated circuits 44, thus stopping the operation of all circuitry by the removal of power and stopping the playing of music.

With respect to function-select circuitry when power is initially applied, by a momentary closure of switch 34 or switch 38, diode 40 or diode 42, respectively, will also ground either terminal T22 (G1) or terminal T21 (GO) of integrated circuit 44, depending on which switch was actuated. At the same time that the power turn-on sequence occurs as described above, the program instructs integrated circuit 44 to read in the state (logic high, for example, 6 volts DC, or logic low, for example, ground,) of terminals T22 and terminal T21 and respond with the "kids" routine if switch 34 has grounded terminal T22 or respond with the "mommy" routine if switch 38 has grounded terminal 21. These routines are described herein subsequently. Diodes 40, 41, 42, 43 are necessary in order to isolate the power turn-on and function select circuitry.

The transistor 62, resistor 63, resistor 64, resistor 65, resistor 66, condenser 67, condenser 68 and diode 69 and a piezo speaker 70 form the audio output circuitry. The music generated by the integrated circuit 44 is coupled to the sound producing speaker 70 through these components in such a manner that the musical tones are slowly decayed in amplitude after each note is sounded rather than allowing them to end abruptly. This decay gives a more pleasing chime-like quality to the music.

A 50% duty cycle square wave is generated by integrated circuit 44 and appears at terminals T28 and T16. Resistors 64 and 65 and condenser 67 smooth the leading and trailing edges of each cycle so that the sound is less harsh than would be heard if listening to an unfiltered square wave. The rise and fall time of each note is altered to obtain a chime-like quality to the sound, as previously mentioned. This is accomplished by allowing each note to turn on rapidly (attack) and fade out slowly (decay) instead of ending abruptly. Transistor 62 is a PNP transistor coupling VCC (6 volts DC) to the speaker. By reducing current to the base of transistor 62, the volume of each note produced by the speaker can be lowered or decayed at a rate controlled by resistor 66, resistor 63 and condenser 68. Each time a new note is generated by integrated circuit 44, the program instructs integrated circuit 44 to change terminal T27 (D1) from a logic high (6 volts DC) to a logic low (ground) for, for example, 10 milliseconds. This action grounds the cathode of diode 69 and resistor 66 which control the discharge time (attack) of condenser 68. After terminal T27 is released by integrated circuit 44, resistor 63 controls the charging time (decay) of condenser 68. When condenser 68 is discharged through resistor 66, transistor 62 is turned on and the note is heard from the speaker 70. As condenser 68 charges up through resistor 63 and the base-emitter junction of transistor 62, the volume of the notes fades and is slowly reduced to zero.

The switch 34 is a momentary impact-actuated switch which is actuated by impact with resulting movement or vibration. The briefest closure of this switch in conjunction with diode 40 turns power on to all circuitry, and in accordance with the program, causes the first song to be played, and causes additional songs to be played in order, if the switch 34 is actuated after each previous song has finished playing but before the time-out period between songs (for example, 10 minutes has elapsed). If the time-out period between songs has elapsed, a subsequent actuation of the switch 34 causes the first song to be played again. This is in accordance with the program for the "kids" routine.

The switch 38 is a momentary push-button switch that in conjunction with diode 41, is intended to be actuated manually by the child's mother. The function of the switch 38 in conjunction with the diodes 43 and 42 turns on power to all circuitry, causes integrated circuit 44 to play a series of songs continuously for approximately, for example, 20 minutes and then turns power off. This is in accordance with the program for the "mommy" routine. Switch 38 also turns music and power off if actuated while music is playing in either mode i.e. "kids" mode or "mommy" mode. The power supply may, for example, be 4 AA size 1.5 volt batteries in series combination totaling 6 volts DC.

It will be obvious to one skilled in the art that the "kids" and "mommy" routines can be changed as desired by altering the program memory of the integrated circuit 44.

It will also be understood that the integrated circuits 44 and 50 have been described with respect to physical units that are particularly suited for a developmental embodiment of the invention. A commercial production embodiment would desirably use a single integrated circuit, for example, National Semiconductor integrated circuit COPS-411L, described in National Semiconductor 1980 "MOS" Databook, with circuit connections and program memory which are obvious to those skilled in the art in view of the foregoing specification.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. An impact-activated toy comprising:

a housing which in its entirety is freely displaceable by an external impact thereon;

an impact-responsive momentary switch mounted in said housing and adapted to be actuated in response to displacement of said housing in its entirely by such impact;

electronic sound generating means responsive to actuation of said switch for generating a sequence of musical melodies appealing to a child in response to successive momentary actuations of said switch caused by successive external impacts on, and displacement of, said housing spaced by less than a predetermined interval from the termination of a preceding melody.

2. A toy in accordance with claim 1 in which said impact-responsive switch is an electromechanical switch.

3. A toy in accordance with claim 1 in which said sound-generating means is mounted in said housing.

4. A toy in accordance with claim 1 in which said sound-generating means generates a given predetermined sequence of musical melodies in response to successive impacts of said housing spaced by less than a predetermined interval from the termination of a preceding melody and generates the first of said predetermined sequence of musical melodies in response to successive impacts of said housing spaced by an interval greater than said predetermined interval.

5. A toy in accordance with claim 1 in which said housing is adapted to be suspended from a crib at substantially one point on said housing so as to be freely displaceable in response to being impacted by a child in the crib.

* * * * *